US009333383B1

(12) United States Patent
Barton

(10) Patent No.: US 9,333,383 B1
(45) Date of Patent: May 10, 2016

(54) WEIGHTED AGILITY LADDER

(71) Applicant: Darrell Barton, Bronx, NY (US)

(72) Inventor: Darrell Barton, Bronx, NY (US)

( * ) Notice: Subject to any disclaimer, the term of this patent is extended or adjusted under 35 U.S.C. 154(b) by 0 days.

(21) Appl. No.: 14/547,286

(22) Filed: Nov. 19, 2014

Related U.S. Application Data

(60) Provisional application No. 61/981,021, filed on Apr. 17, 2014.

(51) Int. Cl.

| | |
|---|---|
| ***A63B 21/00*** | (2006.01) |
| ***A63B 21/02*** | (2006.01) |
| ***A63B 21/06*** | (2006.01) |
| *E06C 1/56* | (2006.01) |

(52) U.S. Cl.
CPC ..... *A63B 21/00047* (2013.01); *A63B 21/06* (2013.01); *E06C 1/56* (2013.01)

(58) Field of Classification Search
CPC ..... A63B 2023/00; A63B 2023/006; A63B 2023/035; A63B 17/00; A63B 17/02; A63B 17/04; A63B 21/00; A63B 21/00007; A63B 21/00058; A63B 21/00061; A63B 21/00065; A63B 21/00069; A63B 21/00138; A63B 21/00156; A63B 21/00163; A63B 21/00181; A63B 21/02; A63B 21/026; A63B 21/028; A63B 21/0442; A63B 21/05; A63B 21/055; A63B 21/0552; A63B 21/0555; A63B 21/0557; A63B 23/04; A63B 23/0458; A63B 23/0464; A63B 69/0028; A63B 69/0035; A63B 7/00; A63B 7/02; A63B 7/04; A63B 7/045; A63B 7/08; A63B 7/085
USPC ..... 482/23, 121–131
See application file for complete search history.

(56) References Cited

U.S. PATENT DOCUMENTS

| | | | | | |
|---|---|---|---|---|---|
| 3,078,954 | A * | 2/1963 | MacLeod | E06C 1/56 | 182/196 |
| 3,415,341 | A * | 12/1968 | Hostetler | E06C 1/56 | 182/198 |
| 3,874,375 | A * | 4/1975 | Penner | A61H 1/0218 | 482/144 |
| 3,907,064 | A * | 9/1975 | Svalberg | E06C 9/14 | 182/196 |
| 3,907,067 | A * | 9/1975 | Kennedy | E06C 9/14 | 182/164 |
| 4,189,030 | A * | 2/1980 | Leslie | E06C 1/56 | 182/196 |

(Continued)

FOREIGN PATENT DOCUMENTS

| | | |
|---|---|---|
| WO | WO2004073808 | 9/2004 |
| WO | WO2007103320 | 9/2007 |

(Continued)

*Primary Examiner* — Stephen Crow
*Assistant Examiner* — Andrews S Lo
(74) *Attorney, Agent, or Firm* — Goldstein Law Offices, P.C.

(57) ABSTRACT

A weighted agility ladder for use as a multi-purpose fitness device. The weighted agility ladder transitions easily for use within variable forms of fitness training, enabling a user to perform a comprehensive fitness routine in a small area. The weighted agility ladder has a pair of ends and a plurality of weighted rungs which can be collected and selectively rigidly coupled together by the user to employ the ladder as a weight. The weighted ladder can have a handle on each end for use of the ladder as a free weight when the weighted rungs are coupled together. Further, the weighted ladder can have nylon or elastic rails to enable loaded movement and an increased range of motion for targeting additional muscle mass during strength training. When the weighted rungs are coupled together, the ladder can serve as additional weight while performing bodyweight exercises, such as planks and squats.

12 Claims, 14 Drawing Sheets

(56) References Cited

U.S. PATENT DOCUMENTS

| | | | | |
|---|---|---|---|---|
| 4,243,121 | A * | 1/1981 | Kiss | E06C 1/525 182/196 |
| 4,260,039 | A * | 4/1981 | Arato | E06C 1/56 182/155 |
| 5,605,205 | A * | 2/1997 | Douglas | E06C 1/56 182/198 |
| 6,447,427 | B1 | 9/2002 | Myrland et al. | |
| 6,475,116 | B2 * | 11/2002 | Chen Wu | A63K 3/043 482/14 |
| 6,671,897 | B1 * | 1/2004 | Votypka | A47K 3/12 182/198 |
| 6,955,631 | B2 | 10/2005 | Chen Wu | |
| 7,874,959 | B2 | 1/2011 | Dieter | |
| 8,317,661 | B2 | 11/2012 | Wight | |
| 2006/0229171 | A1 | 10/2006 | Severino | |
| 2007/0032357 | A1 * | 2/2007 | Piane | A63B 1/00 482/142 |
| 2009/0072111 | A1 * | 3/2009 | Piane, Jr. | A63B 1/00 248/309.1 |
| 2011/0166000 | A1 | 7/2011 | Wight | |
| 2013/0164723 | A1 | 6/2013 | Sakinc | |
| 2015/0099609 | A1 * | 4/2015 | White | A63B 17/00 482/23 |

FOREIGN PATENT DOCUMENTS

| | | |
|---|---|---|
| WO | WO2011076906 | 6/2011 |
| WO | WO2013132989 | 9/2013 |

* cited by examiner

WEIGHTED AGILITY LADDER

CROSS REFERENCES AND RELATED SUBJECT MATTER

This application is a non-provisional of provisional application Ser. No. 61/981,021 filed in the United States Patent Office on Apr. 17, 2014.

TECHNICAL FIELD

The present disclosure relates generally to fitness equipment. More particularly, the present disclosure relates to an agility ladder.

BACKGROUND

Health benefits of physical exercise are widely known. An agility ladder is traditionally used to improve the cardiovascular health and coordination of an athlete. However, the agility ladder provides limited effectiveness for strength training, particularly upper body strength training. As a result, the typical athlete will supplement agility training using the agility ladder with additional forms of training using fitness devices currently marketed to athletes. Some of these devices include large units of weight equipment and small, individual devices intended to provide a mechanism to build strength within a particular muscle group.

Nevertheless, the athlete is often inconvenienced by drawbacks that are frequently associated with the home use of such strength training devices. Some of the drawbacks include bulkiness, lack of durability, and a limited exercise range. Further, such strength training equipment is often very expensive to purchase for home use and therefore, inaccessible to many athletes.

Yet further, positioning bulky strength training equipment around the agility ladder can make the agile foot movement performed across the ladder hazardous to the athlete. If the athlete is injured, the countless hours spent training can be futile, and the efficacy of the agility ladder as a tool for increasing the athlete's agility and coordination can be compromised. Additionally, the space necessary to store individual pieces of training equipment may make the use of such individual units of equipment undesirable.

Still other athletes will use the agility ladder in a health club setting to supplement the agility training with alternate forms of training on devices available in the club. However, agility ladders are often employed to maximize an effective workout in a short span of time. Due to the requirement of having to travel to the gym, the use of the agility ladder for this intended purpose is often frustrated.

Additionally, the athlete can be traveling and unaware of where health clubs in the travel destination are located. As a result, the athlete often enlists the services of a personal trainer who can make a visit to the athlete's home or hotel room. Although some portable strength training devices have been developed in order to accommodate the frustrated athlete, such devices are similarly associated with bulkiness and a limited range of exercise. Both the athlete and the personal trainer could benefit from having a fitness device that is easily portable, comprised of minimal components, and which can enable a wide range of exercises.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment is to provide an agility ladder which can be used as a multi-purpose fitness device. Accordingly, an aspect of an example embodiment in the present disclosure provides an agility ladder having a plurality of weighted rungs for use of the ladder as a weight.

A further aspect of an example embodiment is to provide a weighted agility ladder which transitions easily for use within variable forms of fitness training performed as part of a comprehensive fitness routine. Accordingly, an aspect of an example embodiment in the present disclosure provides an agility ladder having rungs which can be easily collected and coupled together to form a weight for weight training.

Yet a further aspect of an example embodiment is to provide a weighted agility ladder which can be used in a small area as a free-weight for strength training. Accordingly, an aspect of an example embodiment in the present disclosure provides a weighted agility ladder having a pair of ends, and a handle on each end for use of the weight through different planes of motion when the weighted rungs of the ladder are coupled together.

Still a further aspect of an example embodiment is to provide a weighted agility ladder which can be used to increase a user's range of motion and target muscles not strengthened using traditional free-weights. Accordingly, an aspect of an example embodiment in the present disclosure provides a weighted agility ladder having nylon or elastic rails for loaded movement across the user's body while strength training.

Accordingly, the present disclosure describes a weighted agility ladder. The weighted agility ladder can be used as a multi-purpose fitness device which transitions easily for use within variable forms of fitness training, enabling a user to perform a comprehensive fitness routine in a small area. The weighted agility ladder has a pair of ends and a plurality of weighted rungs which can be collected and selectively coupled together by the user to employ the ladder as a weight. The weighted ladder can have a handle on each end for use of the ladder as a free weight when the weighted rungs are coupled together. Further, the weighted ladder can have nylon or elastic rails to enable loaded movement and an increased range of motion for targeting additional muscle mass during strength training. When the weighted rungs are coupled together, the ladder can also serve as additional weight while performing bodyweight exercises, such as planks and squats.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1A:
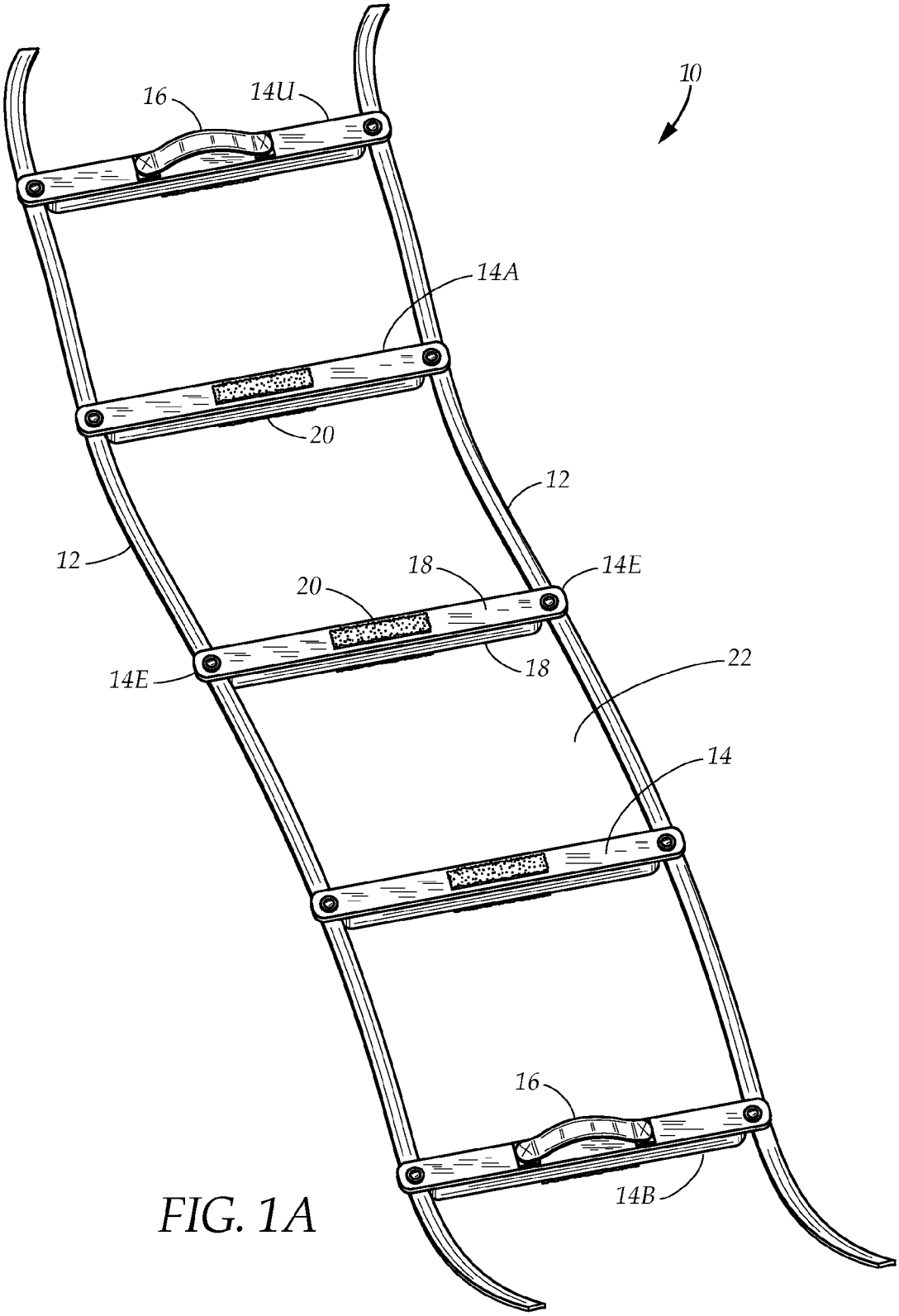
FIG. 1A is a perspective view of an example embodiment of a weighted agility ladder having nylon rails.

FIG. 1A illustrates a weighted agility ladder 10 which can be engaged by a user for use as a multi-purpose fitness device. The weighted agility ladder includes at least two rails 12 with a plurality of rungs 14 coupled laterally therebetween. The plurality of rungs 14 in the agility ladder 10 are weighted and may be configured for use as a free weight when the weighted rungs 14 are stacked and selectively coupled together by the user. Among the rungs 14 of the weighted agility ladder 10 are an uppermost rung 14U and a bottommost rung 14B which can each include a handle 16 thereon to further enable use of the agility ladder 10 as a free weight. Between the upper most rung 14U and bottommost rung 14B are several intermediate rungs 14A.

The rails 12 of the weighted agility ladder 10 are collapsible to enable the stacking and the selective coupling of the weighted rungs 14. In addition, the rails 12 are flexible and elastic. Accordingly they are stretchable to provide resistance for exercising, having a similar degree of stretchability as resistance bands commonly used for exercising. In an example embodiment illustrated in FIG. 1B, the rails 12 can be nylon. When the weighted rungs 14 are coupled therebetween, the rails 12 can enable use of the weighted agility ladder 10 for loaded movement across a user's body. The elasticity of the rails 12 can further enable the user to achieve an increased range of motion while strength training. As a result, the rails 12 and the weighted rungs 14 of the agility ladder 10 are configured to enable the performance of a comprehensive fitness routine, including, but not limited to strength training, cardiovascular exercise, and agility training.

Figure 1B:
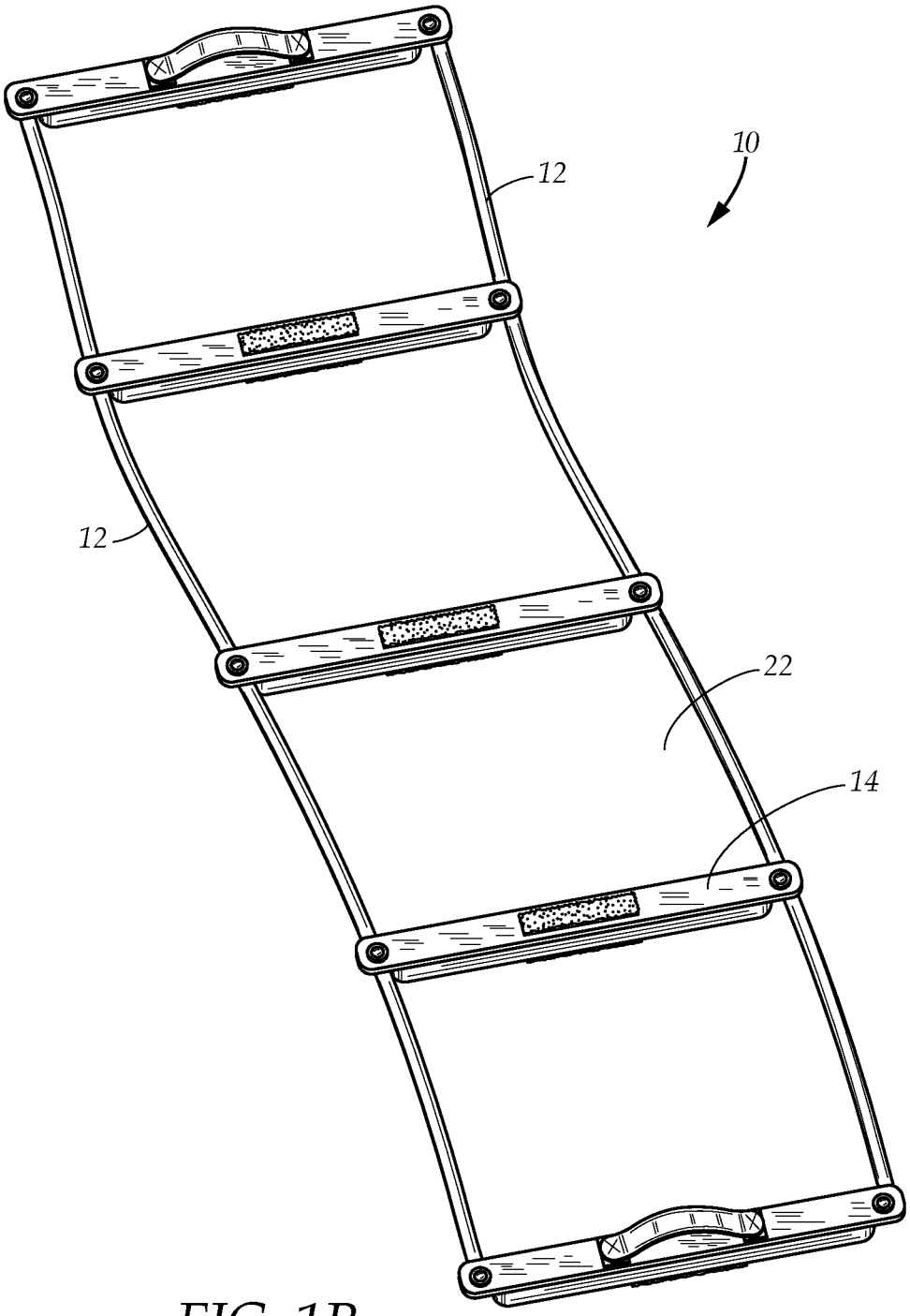
FIG. 1B is a perspective view of another example embodiment of the weighted agility ladder having elastic band rails.
Figure 1C:
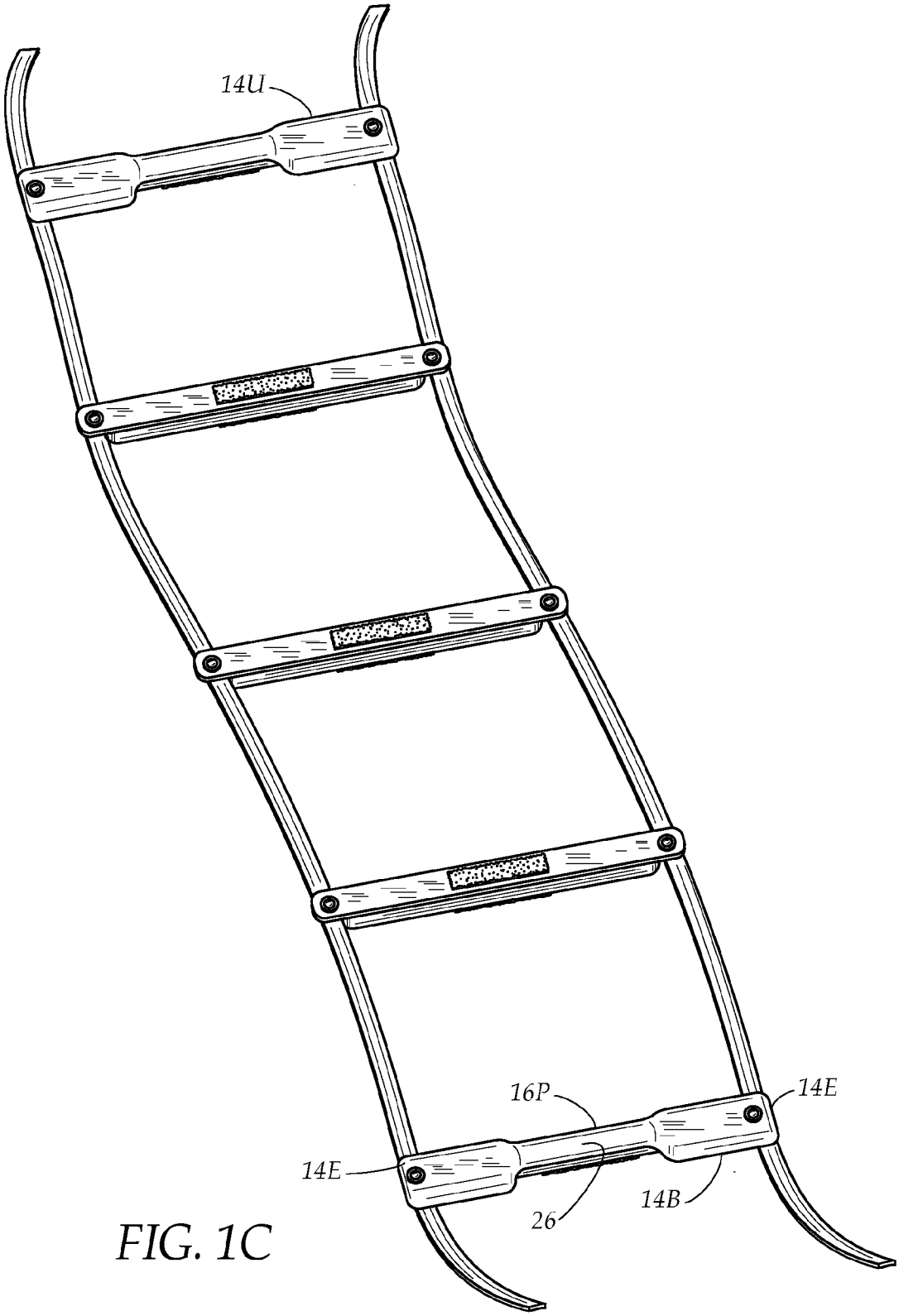
FIG. 1C is a perspective view of yet another example embodiment of the weighted agility ladder having a pair of gripping handles.

The rails 12 have a length along which the plurality of weighted rungs 14 are positioned, generally at even intervals as illustrated in FIG. 1A such that the rails 12 extend parallel to each other and the rungs 14 extend parallel to each other. The fixing of position on the rails 12 establishes that each rung 14 has at least one adjacent rung. The weighted rungs 14 have a pair of ends 14E configured to extend laterally between the rails 12, such that each of the rails 12 is attached near one of the ends 14E. The weighted rungs 14 and the rails 12 can be unitary. Alternatively, the weighted rungs 14 and the rails 12 can be separate components of the weighted agility ladder 10, as illustrated in FIG. 1A-1C. Additionally, the agility ladder 10 can be selectively coupled to another similarly structured agility ladder to enable increasingly complex foot movement by the user when traversing the agility ladders. In an example embodiment, said other weighted agility ladder can be positioned substantially parallel to the agility ladder 10. The ends 14E of the weighted rungs 14 of both agility ladders 10 can be selectively coupled together.

Figure 2A:
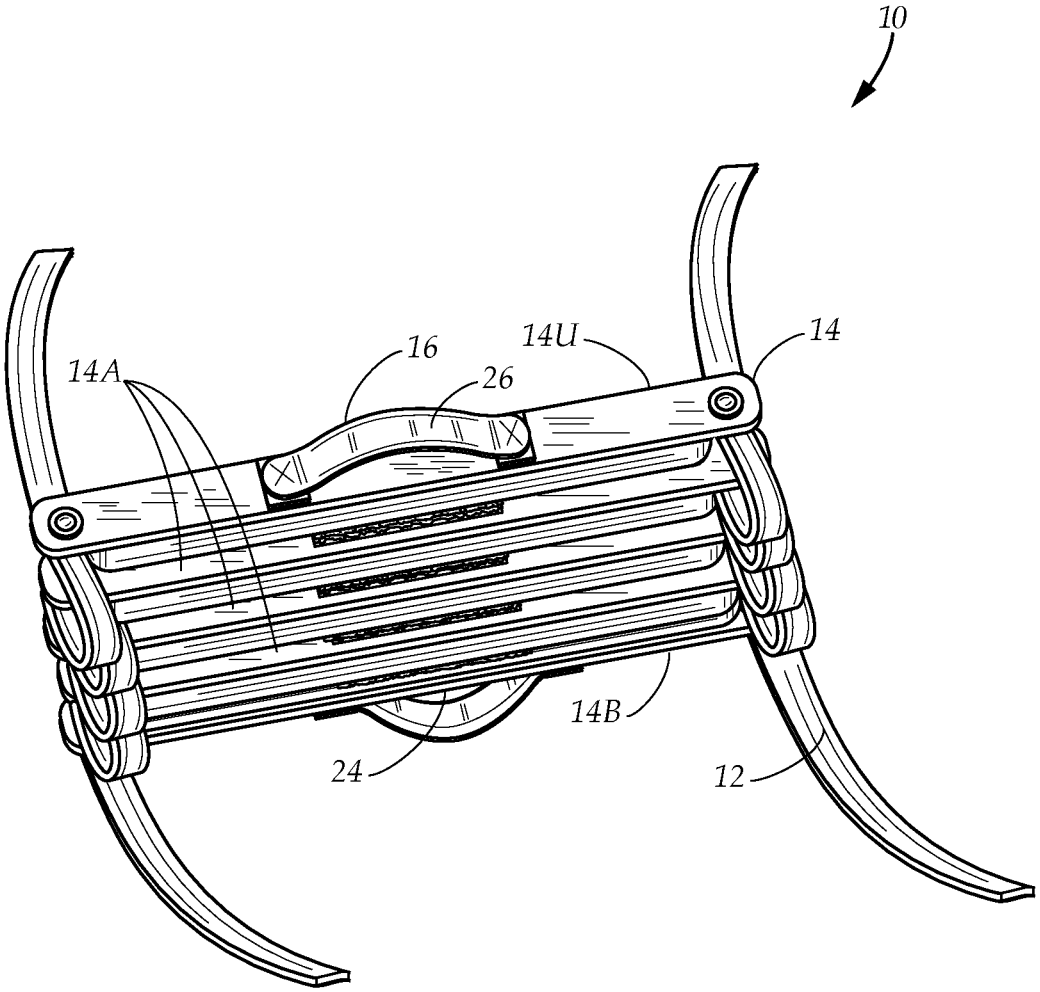
FIG. 2A is a perspective view of the weighted agility ladder with rungs coupled together.

The weighted rungs 14 have a pair of faces 18. At least one face 18 of each weighted rung can include a coupler 20, such as hook and loop fasteners as seen in FIG. 1A, for operably coupling the weighted rungs together, rigidly attaching rungs to adjacent rungs, as illustrated in FIG. 2A. Alternative means for coupling the weighted rungs 14 include, but are not limited to, adhesive, pins, braces, brackets, retainers, magnets, and mating fasteners. While reference is made to specific means for coupling the weighted rungs 14 together, it is understood that such means are not to be limited to those discussed herein.

Yet further, the weighted agility ladder 10 can also be configured for compact storage and easy transportation via the stacking and the coupling of the weighted rungs 14. Consequently, the weighted agility ladder 10 is configured for fitness training in a plurality of locations and in spatially confined areas.

The weighted rungs 14 of the agility ladder 10 are configured for easy transition between variable forms of fitness training, such as strength training and agility training. When the weighted rungs 14 are spaced apart and the rails 12 elongated therebetween, the weighted rungs 14 and rails 12 together define a plurality of substantially rectangular openings 22. The weighted rungs 14 are spaced a sufficient distance apart to accommodate the paces of the user traversing the openings 22 of the weighted agility ladder 10. In an example embodiment, the weighted rungs 14 are evenly spaced along the length of the rails 12 in fixed positions thereon. In another example embodiment, the weighted rungs 14 can be selectively repositioned along the length of the rails 12 to enable fluctuation in the user's paces as the user traverses the weighted agility ladder 10. Further, the weighted rungs 14 are sufficiently narrow in width for easy collapsing of the weighted agility ladder 10 for use as a free weight. The weighted rungs 14 can be of uniform weight. Preferably the rungs each weigh between two and ten pounds. The weighted rungs 14 can be of variable weight to enable fitness training that is personalized to the user's fitness levels.

Figure 5:
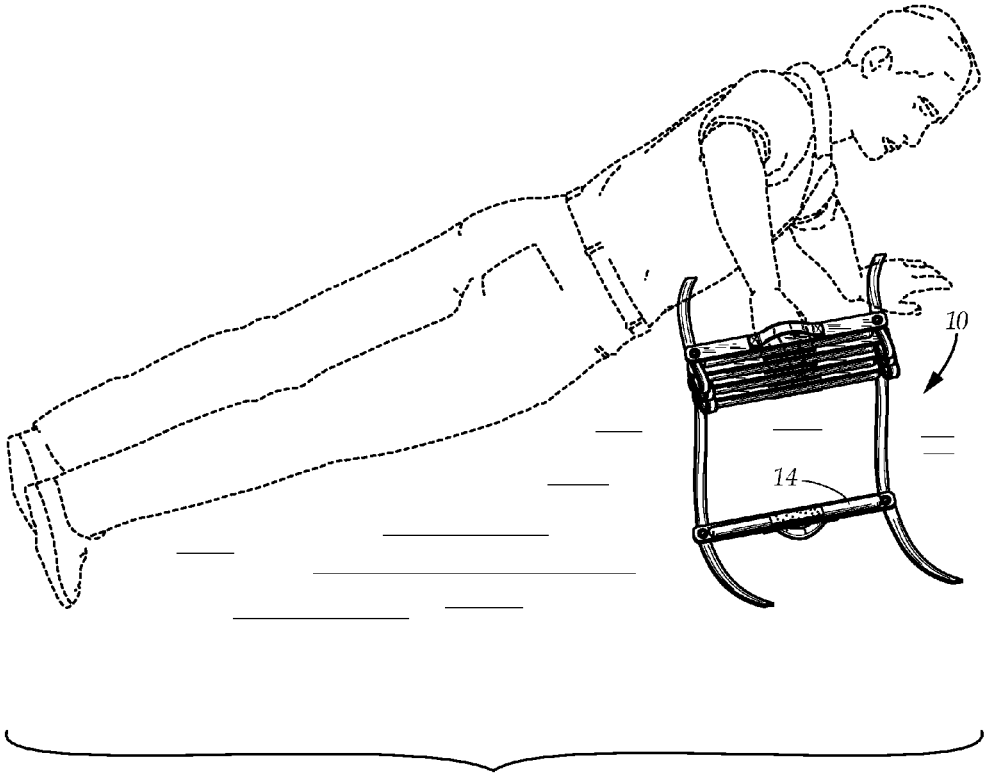
FIG. 5 is a perspective view of the weighted agility ladder with rungs partially coupled together by the user in a planking position.

In FIG. 2A, the weighted rungs 14 of the agility ladder 10 are stacked and operatively coupled together. The rails 12 collapse and can fold between the weighted rungs 14. The weighted rungs 14 can be configured for stacking flush against one another. Alternatively, the weighted rungs 14 can be configured in such shapes as an arch, such that the pairs of ends 14E of the weighted rungs 14 can be operatively coupled together. Further, less than all of the weighted rungs 14 can be stacked and coupled together for strength training using less than the maximum weight enabled by the weighted rungs 14. As illustrated in FIG. 5, the user can engage the weighted agility ladder 10 such that at least one weighted rung 14 remains uncoupled and positioned on a surface. The remaining weighted rungs 14 are coupled and are engaged for use as a free weight while fitness training.

As previously noted, the uppermost rung 14U and the bottommost rung 14B of the weighted agility ladder 10 can include at least one handle 16. The handles 16 enable the user to easily engage the weighted agility ladder 10 for strength training. In the example embodiment illustrated in FIG. 2A, the handles 16 are coupled to the uppermost rung 14U and the bottommost rung 14B, directing opposing each other and the couplers 20 on the uppermost rung 14U and the bottommost rung 14B. Further, the handles 16 define openings 24 through which the user can insert a hand for use of the weighted agility ladder 10 as a free weight. The handles 16 are sufficiently narrow in width to enable the user to effectively grip the weighted agility ladder 10 for use in strength training. The handles 16 can include a gripping surface 26 for cushioning and securing the user's hands while strength training. When the weighted rungs 14 of the agility ladder 10 are coupled together to form a weight, the uppermost rung 14U and the bottommost rung 14B, including the handles 16, are pivoted outwardly away from the intermediary rungs 14A. Accordingly, such outward pivoting orients the couplers 20 on the uppermost rung 14U and the bottommost rung 14B towards the adjacent rungs 14 for selective attachment thereto. Further, the handles 16 can be configured to pivot around an axis extending along the weighted agility ladder 10 to further accommodate the loaded movement of the weighted rungs 14 across the user's body.

In another example embodiment, the handles 16 an be integrated into the structure of the uppermost rung 14U and the bottommost rung 14B, respectively. The handles 16P can extend between the pair of ends 14E of the weighted rungs 14, as illustrated in FIG. 1C. The handles 16P are preferably cylindrical in shape, and are sufficiently narrow in width to enable the user to effectively grip the weighted agility ladder 10 for use as a free weight, such as a dumbbell. The handles 16P can further include the gripping surface 26 for cushioning and securing the user's hands while strength training. The uppermost rung 14U and the bottommost rung 14B, including the handles 16P, are configured for selective attachment to the adjacent rungs 14, as discussed hereinabove.

Figure 2B:
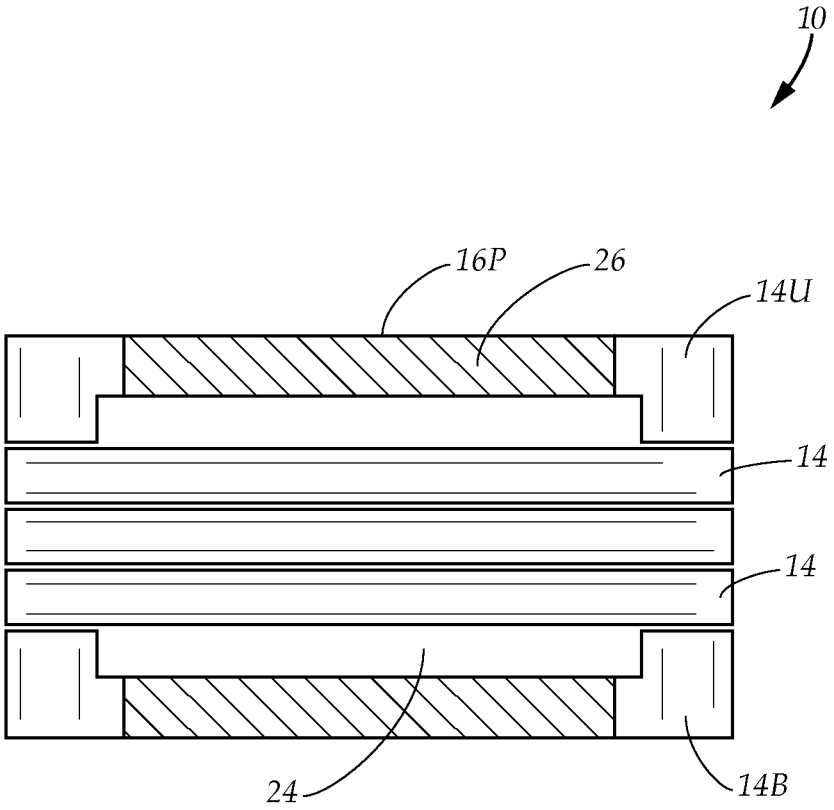
FIG. 2B is a front elevational, sectional view of the weighted agility ladder with rungs coupled together.

Further, FIG. 2B diagramatically illustrates an example embodiment of how the weighted rungs 14 of the agility ladder 10 embodied in FIG. 1C can be selectively coupled and used as a free weight for strength training. When the weighted rungs 14 are stacked and coupled together, the uppermost rung 14U and the bottommost rung 14B, and the associated adjacent rungs 14 to which they are coupled, define the openings 24. Gripping surfaces 26 on the handles are grasped by the user's hands which are inserted through the openings 24. The user can then employ the weighted agility ladder 10 for strength training.

Figure 3:
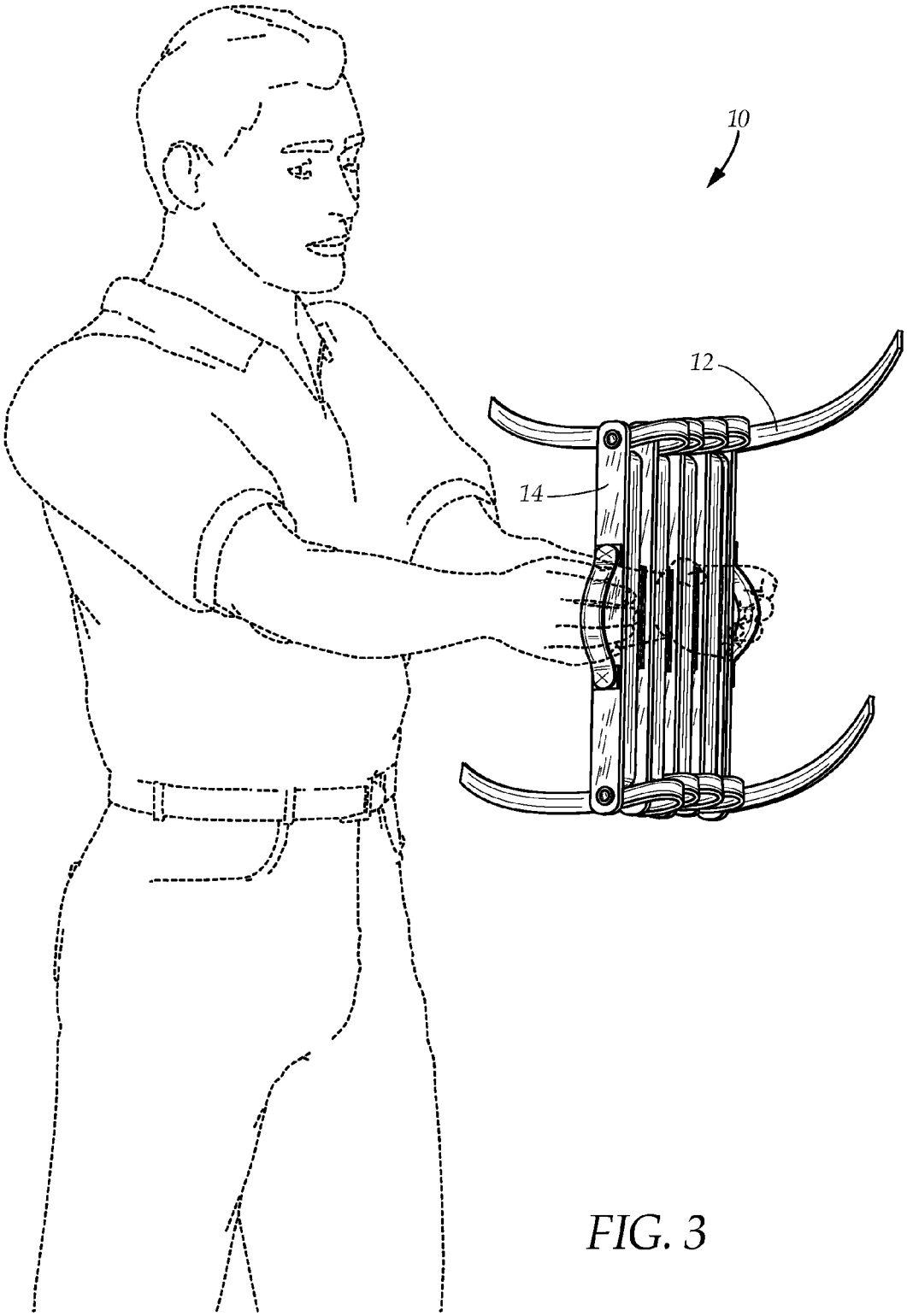
FIG. 3 is a perspective view of the weighted agility ladder with rungs coupled together by a user.

The rails 12 of the weighted agility ladder 10 enable operative use of the agility ladder 10 for variable forms of fitness training. FIG. 1A illustrates an example embodiment of the weighted agility ladder 10 including nylon rails 12. When the weighted rungs 14 are coupled therebetween, the nylon rails 12 enable different modes of loaded movement across the user's body while strength training, as illustrated in FIGS. 3-6. The nylon rails 12 enable the user to engage the weighted agility ladder 10 for strength training, such as with accordion-like expansion and contraction of the weighted rungs 14 when the user is standing upright, as illustrated in FIG. 3. While in this position, the user can easily transition the weighted agility ladder 10 into a free weight to further enable additional modes of loaded movement across the user's body.

Alternatively, FIG. 1B illustrates another example embodiment of the weighted agility ladder 10 wherein the rails 12 are elastic, preferably resistance bands. Fitness training performed using the weighted agility ladder 10 including elastic rails 12 enables the user to exercise parts of the user's body not traditionally strengthened using free weights, resulting in increased muscle mass. The elastic rails 12 enable the user to easily transition from agility training and cardiovascular exercise performed within the openings 22 of the weighted rungs 14 when the agility ladder 10 is positioned on the surface, to strength training using loaded movement and an increased range of motion across the user's body. As discussed hereinabove, the elastic rails 13 enable use of the weighted agility ladder 10 for strength training, such as with accordion-like expansion and contraction of the weighted rungs 14 when the user is standing upright. While in this position, the user can easily transition the weighted agility ladder 10 into a free weight to further enable additional modes of loaded movement across the body.

Figure 7:
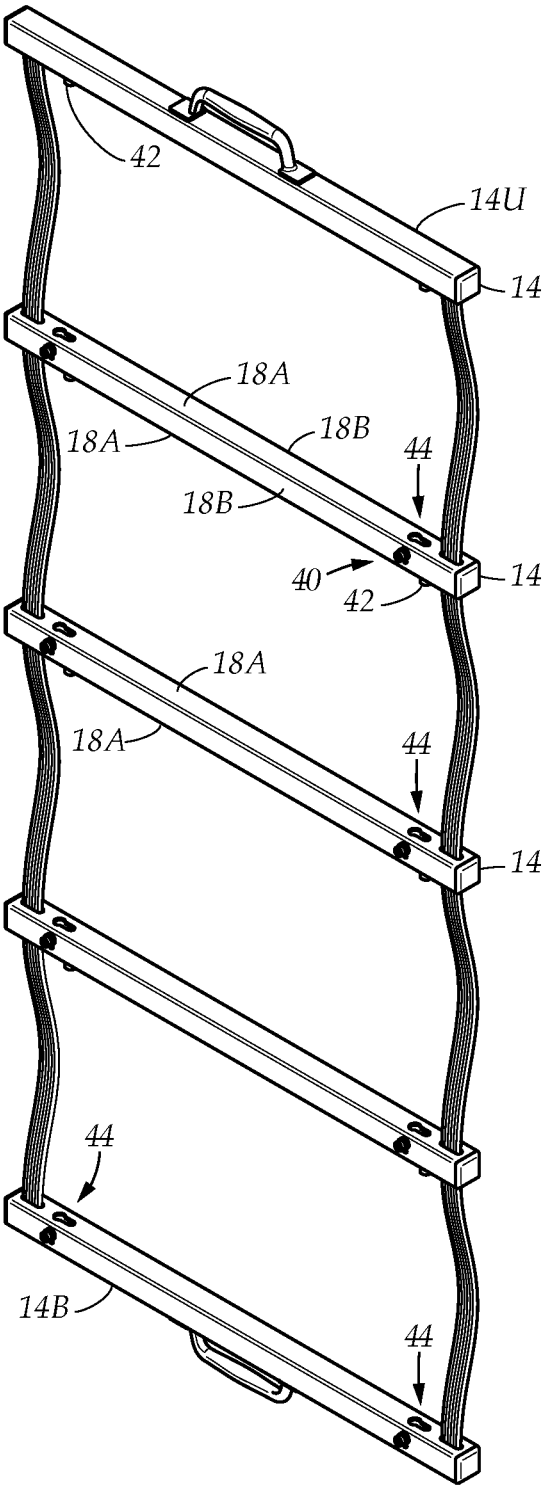
FIG. 7 is a perspective view of an embodiment of the weighted agility ladder, wherein at least some of the rungs have an attachment mechanism for selectively securing some or all rungs together.
Figure 9:
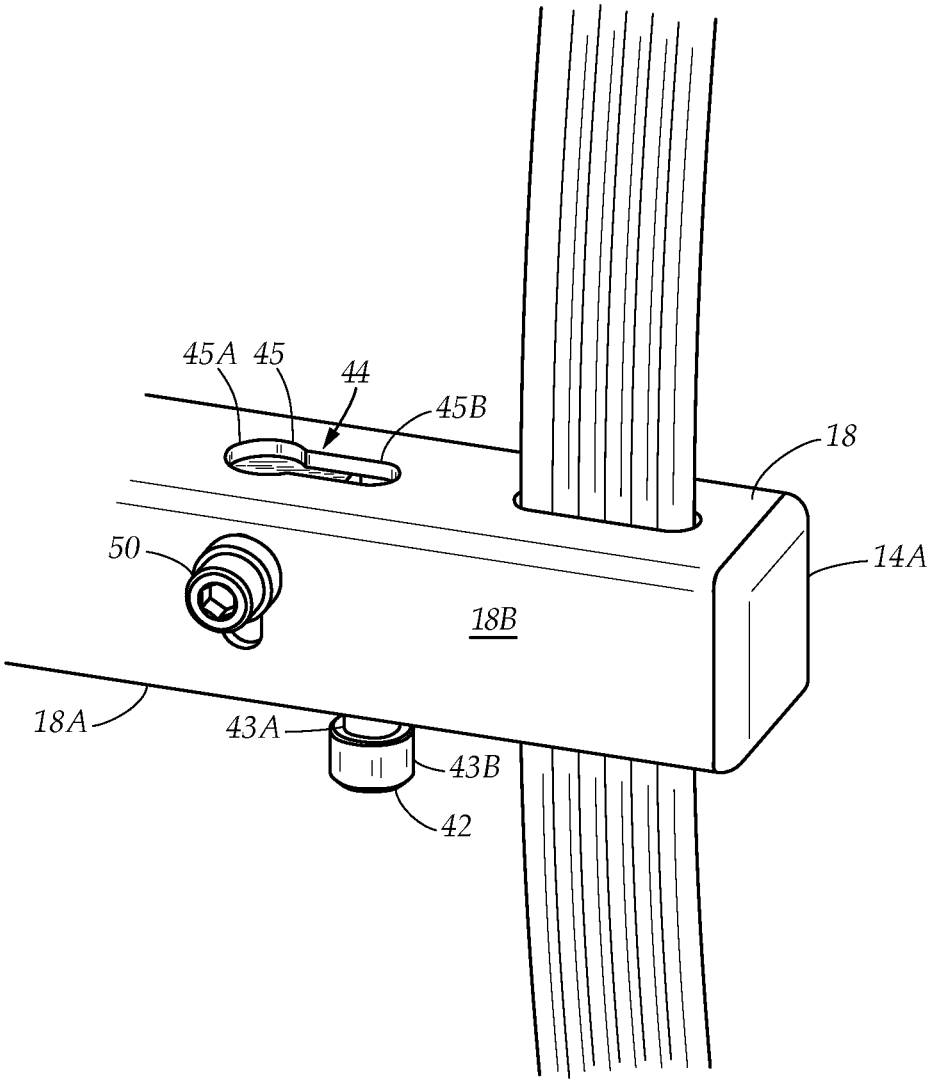
FIG. 9 is an enlarged perspective view, showing the attachment mechanism on one of the rungs.
Figure 10A:
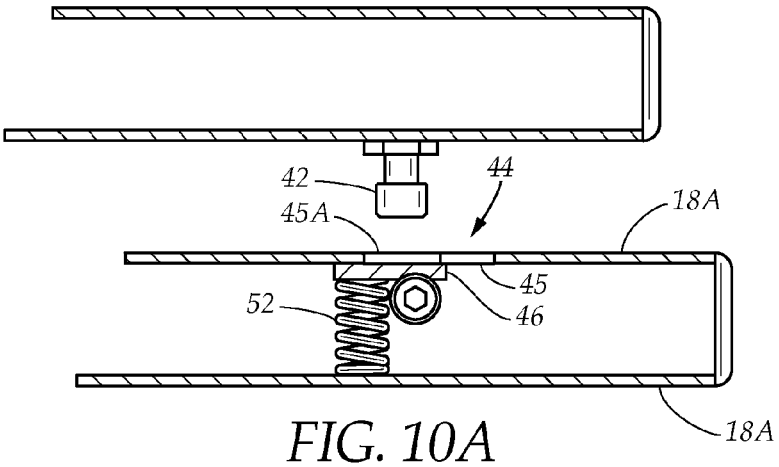
FIG. 10A is a side elevational view, with parts broken away, illustrating on rung about to be secured to another rung, using the attachment mechanism.
Figure 10B:
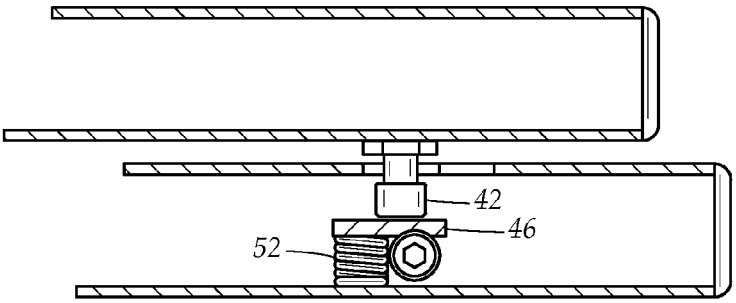
FIG. 10B is a side elevational view, similar to FIG. 10A, with parts broken away, wherein the attachment projection from one rung is pressing against the attachment plate and extended into the attachment socket of the other rung.
Figure 10C:
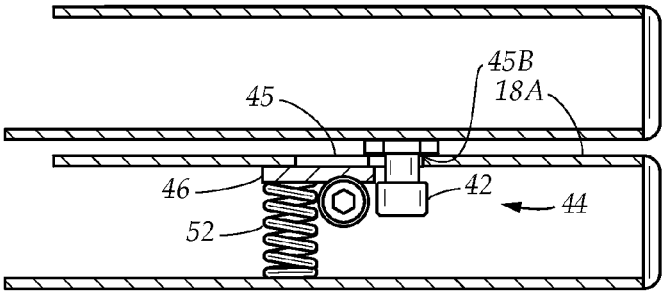
FIG. 10C is a side elevational view, similar to FIG. 10B, wherein the attachment plate has recoiled, holding the attachment projection and thereby securing the rungs together.

FIG. 7 illustrates a further embodiment wherein the rungs 14 each have a substantially rectangular cross section, having inner faces 18A and outer faces 18B. The inner faces 18A are configured to selectively join with the inner faces of adjacent rungs 14. In particular, adjacent rungs may be joined by an attachment mechanism 40, which includes a plug 42 on one of the rungs 14 that selectively mates with a socket 44 on the other of the rungs 14. Referring to FIG. 9, each of the intermediate rungs 14A has at least one plug 42 on one of its inner faces 18A, and a socket 44 on the other of its inner faces 18A. The plug 42 includes a neck 43A, and a larger base 43B. The socket 44 includes a slot 45 and a plate 46. The slot 45 is preferably keyed, having a enlarged portion 45A which is sized to accept the plug 42, and a narrow portion 45B which is sized to retain the plug 42. The attachment mechanism may also include an actuating lever 50 on one of the outer faces 18B which selectively moves the plate 46. Referring to FIG. 10A-10C, mating one of the plugs 42 with one of the sockets 44 involves positioning the plug 42 over the enlarged portion 45A of the slot 45 (FIG. 10A) and then pushing the plate 46 downwardly by the plug 42 as the plug 42 is inserted into the slot 45 within an interior space of the rung. A spring 52 extends between the plate 46 and the inner face 18A that is opposite from the slot 45, and biases the plate 46 toward the slot 45. Accordingly, as the plug 42 pushes the plate 46 downwardly, the spring 52 is compressed (FIG. 10B). Finally, the plug is slid laterally along the slot 45 into the narrow portion 45B of the slot 45. When the plug 42 reaches the narrow portion 45B, it clears the plate 46 which then snaps against the inner face 18A that has the slot 45 by releasing tension of the spring 52. The plate 46 thereby prevents the plug 42 from moving laterally within the slot 45 and the narrow portion 45B prevents the plug 42 from being withdrawn from the slot 45. Accordingly, the plug 42 is effectively locked within the socket 44, unless the actuating lever 50 is manually pushed downwardly to allow the plug 42 to clear the plate 46 to slide laterally into position where it can be withdrawn from the slot 45 through the enlarged portion 45A.

Figure 8:
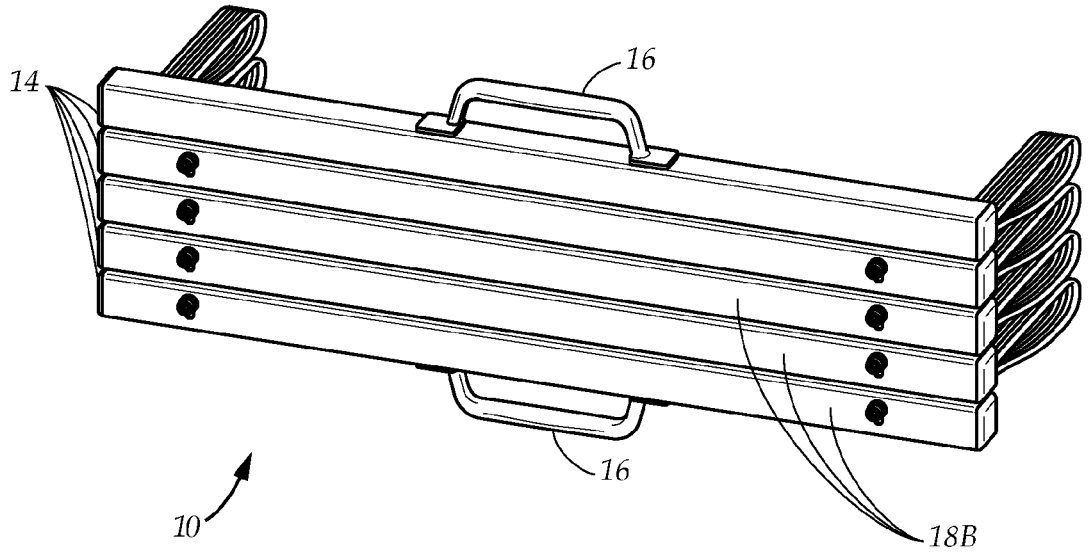
FIG. 8 is a perspective view showing all rungs secured together.

Referring to FIG. 7 again, each of the intermediate rungs 14A have at least one plug 42 and one socket 44. In particular, each of the intermediate rungs preferably have two plugs and sockets 44—one set near each of its ends 14E. The uppermost rung 14U and bottommost rung 14B, however, each have either the plugs or the sockets—whatever is the opposite of the intermediate rung 14A immediately adjacent thereto. Referring to FIG. 8, all rungs 14 of the agility ladder 12 are shown linked together, such the inner faces 18 of rungs are directly attached against the inner faces 18 of adjacent rungs, creating a solid unit which may be held by the handles 16 and used as a free weight. In particular, all of the outer faces 18B extend substantially parallel and coextensive with each other.

Figure 6:
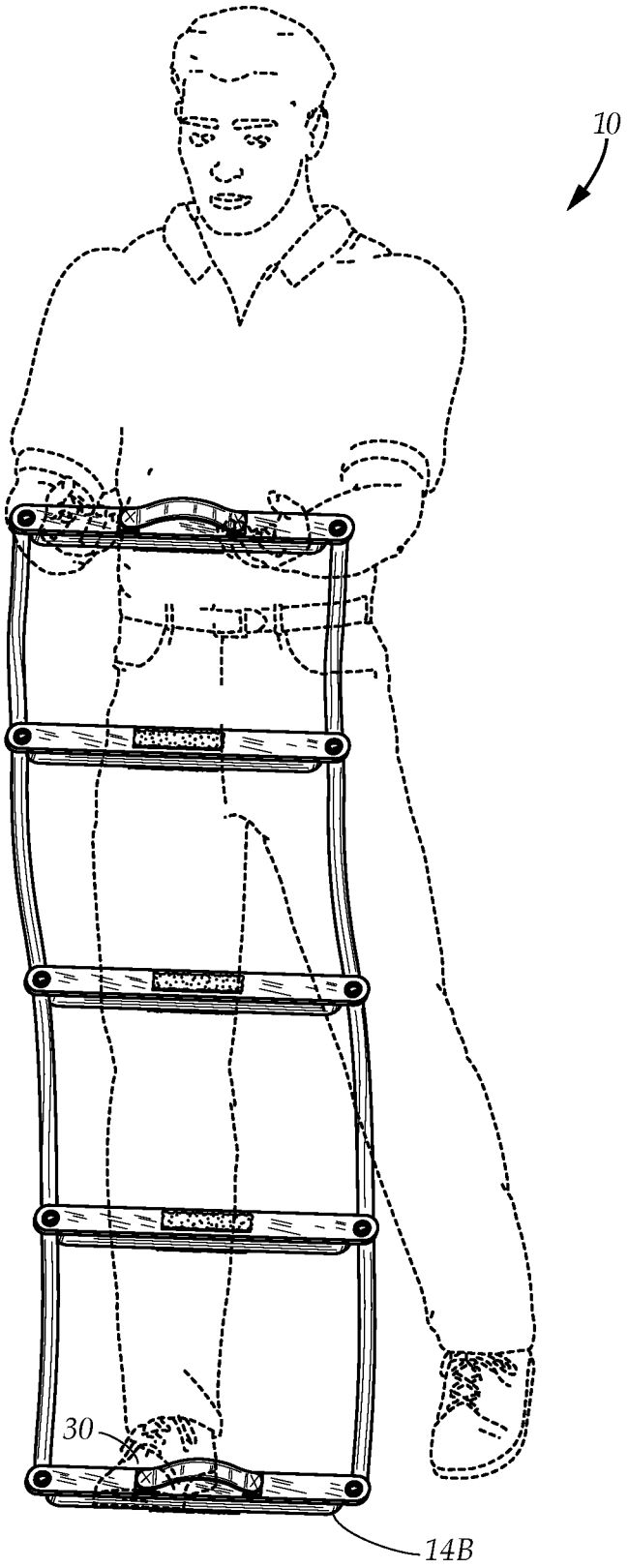
FIG. 6 is a perspective view of the weighted agility ladder stretched upwards from the ground by the user.

Further examples of how the weighted agility ladder 10 can enable loaded movement across the user's body are illustrated in FIG. 6. In one example embodiment, the user can stabilize the bottommost rung 14B of the weighted agility ladder 10 with a user's foot 30, and perform a plurality of exercises across the user's body, such as bicep curls and dead lifts. When performed using the weighted agility ladder 10 having rails comprised of elastic rails 13, the range of motion is maximized.

Figure 4:
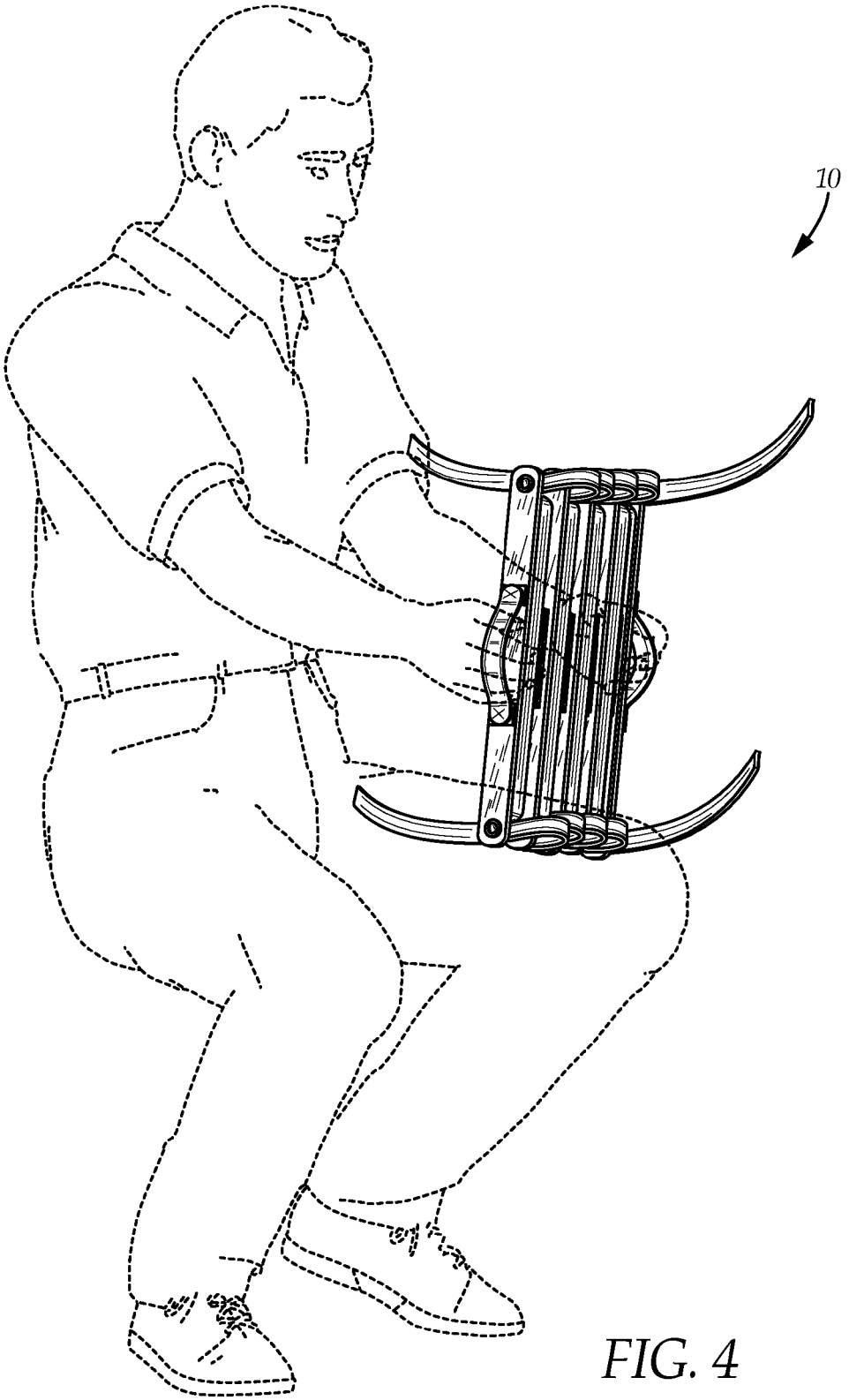
FIG. 4 is a perspective view of the weighted agility ladder with rungs coupled together by the user in a squatting position.

The user can combine strength training using the modes of loaded movement discussed hereinabove, with variable other forms of fitness training, such as lower body strength training, cardiovascular exercise, and strength training. FIG. 4 illustrates how the weighted agility ladder 10 can be used to combine upper body strength training and lower body strength training. More particularly, the user can engage the weighted agility ladder 10 to incorporate additional weight while performing lower body strength training exercises, such as a squat or a lunge.

Yet further, the user can engage the weighted agility ladder 10 to complete a comprehensive fitness routine in a small amount of space, and in a short amount of time. In an example embodiment, the user can selectively engage the weighted agility ladder 10 as a free weight for use while performing a complete series of floor exercises, such as a plank or a push-up, as illustrated in FIG. 5. FIG. 5 illustrates how the user can maximize the results of strength training by integrating the weighted agility ladder 10, and the loaded movement it provides, into the user's floor exercises. In another example embodiment, the user can transition the weighted agility ladder 10 into a free weight without having to stop and transition to a separate fitness unit after performing a series of body-weight exercises, such as a bear walk, across the uncoupled weighted rungs 14 of the agility ladder 10. Consequently, the weighted agility ladder 10 can be used as a complete fitness tool for circuit training and the rapid exercise transitions required therein. While reference is made to specific combinations of exercises which the user can perform using the weighted agility ladder 10 as a multi-purpose fitness device, it is understood that such exercises are not limited to those described herein. Further, all of the exercises can be performed using any example embodiment of the weighted agility ladder 10 discussed herein.

Figure 11A:
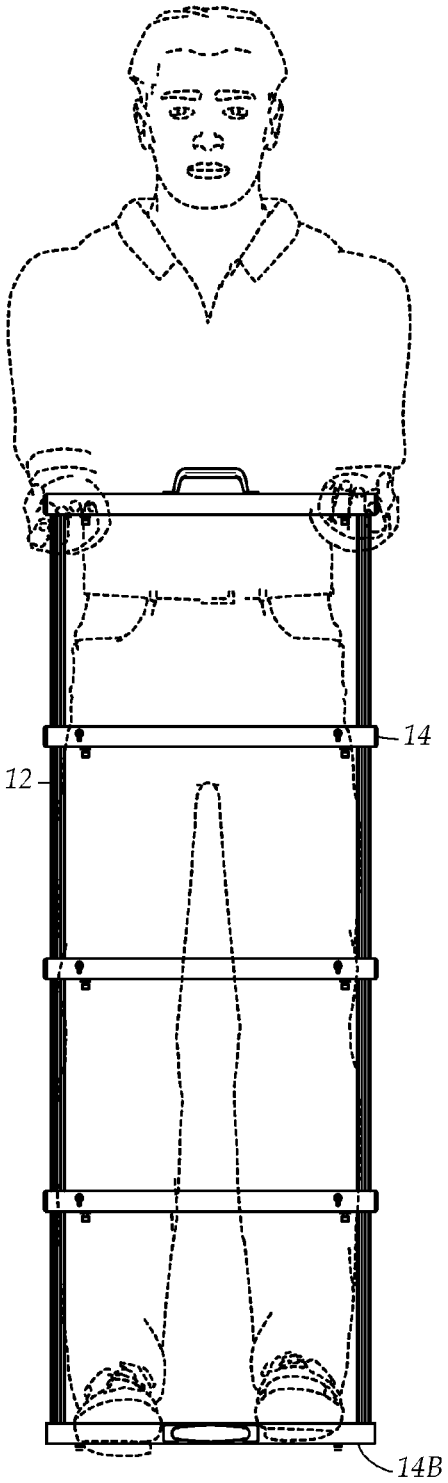
FIG. 11A is a front elevational view, showing the agility ladder in use performing an exercise, wherein all rungs are separated.
Figure 11B:
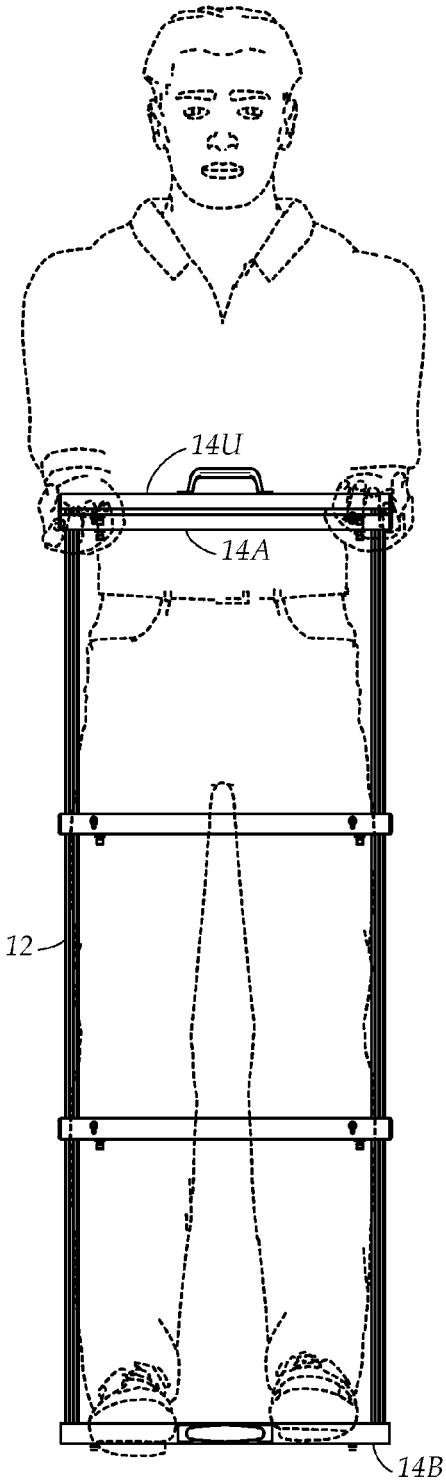
FIG. 11B is a front elevational view similar to FIG. 11A, showing the agility ladder in user performing an exercise, except wherein two rungs are secured to each other to alter dynamics of the exercise.

FIGS. 11A and 11B illustrate the embodiment of FIG. 7, in use for performing an exercise, such as curling. In FIG. 11A, none of the rungs 14 are linked together, and the user is standing upon the lowermost rung 14B, and is grasping the uppermost rung 14U—allowing the exercise to be performed with a certain response by the elasticity of the rails 12. In FIG. 11B, however, the uppermost rung 14U and the intermediate rung 14A immediately adjacent thereto are locked together. This changes the dynamic of the exercise, wherein the rails 12 much be stretched more to extend the same distance between the uppermost rung 14U and bottommost rung 14B, thereby creating more tension in the rails 12 and requiring more effort by the user.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a weighted agility ladder. The disclosure is illustrated by example in the drawing figures, and throughout the written description. It should be understood that numerous variations are possible, while adhering to the inventive concept. Such variations are contemplated as being a part of the present disclosure.

What is claimed is:

1. A weighted agility ladder, comprising:

an uppermost rung, a lowermost rung, and a plurality of intermediate rungs, the rungs are each weighted and each have a pair of ends;

a pair of rails, the rails attaching to and connecting the rungs such that the rails extend substantially parallel to each other and the rungs extend substantially parallel to each other, each rail attaching near one of the ends of each rung, the rungs are spaced apart by the rails, the rails establishing relative positioning of the rungs such that each rung has at least one other of the rungs adjacent thereto, the rails are elastic for stretching and tensioning when one of the rungs is pulled away from another of the rungs;

wherein the rungs each have a pair of inner sides, each rung has at least one connector for securing that rung to one of its adjacent rungs, the at least one connector on each rung is selected from a socket and a plug;

wherein each of the intermediate rungs have at least one socket on one of its inner sides and one plug on the other of its inner sides; and wherein the plug is configured to be inserted in the socket of an adjacent rung downwardly within an interior space of the adjacent rung and slidable laterally within the interior space for selectively locking and unlocking each adjacent rung to one other.

2. The weighted agility ladder as recited in claim 1, wherein each rung may be directly secured to adjacent rungs to create a unitary object.

3. The weighted agility ladder as recited in claim 2, wherein the uppermost rung has a handle midway between its ends and the lowermost rung has a handle midway between its ends.

4. The weighted agility ladder as recited in claim 1, wherein each socket includes a slot having an enlarged portion and a narrow portion, a plate, a spring that biases the plate against the slot, and an actuation lever for manually moving the plate away from the slot.

5. The weighted agility ladder as recited in claim 4, wherein each rung weighs at least two pounds.

6. The weighted agility ladder as recited in claim 5, wherein the rungs are substantially rectangular prism shaped, wherein the plug on each intermediate rung is a pair of plugs located on one of its inner sides near the ends of the rung, and the socket on each intermediate rung is a pair of sockets each having a slot located on the other of the inner sides.

7. The weighted agility ladder as recited in claim 6, wherein each rung may be directly secured to adjacent rungs to create a unitary object.

8. The weighted agility ladder as recited in claim 7, wherein the uppermost rung has a handle midway between its ends and the lowermost rung has a handle midway between its ends.

9. A weighted agility ladder, comprising:

an uppermost rung, a lowermost rung, and a plurality of intermediate rungs, the rungs each weigh at least two pounds and each have a pair of ends and a pair of inner surfaces;

a pair of rails, the rails attaching to and connecting the rungs such that the rails extend substantially parallel to each other and the rungs extend substantially parallel to each other, each rail attaching near one of the ends of each rung, the rungs are spaced apart by the rails, the rails establishing relative positioning of the rungs such that each rung has at least one other of the rungs adjacent thereto;

wherein the rungs each have at least one connector for securing that rung directly to one of its adjacent rungs such that the inner surfaces of said rung is rigidly attached to the inner surface of said adjacent rung, wherein the connector on each intermediate rung includes a pair of plugs extending from one of the inner surfaces and a pair of sockets each having a slot on the other of the inner surfaces, wherein the connector on the uppermost rung includes a pair of connectors selected from the group consisting of plugs and sockets, and the connector on the bottommost rung includes a pair of connectors selected from the group consisting of plugs and sockets; and wherein the plug is configured to be inserted in the socket of an adjacent rung downwardly within an interior space of the adjacent rung and slidable laterally within the interior space for selectively locking and unlocking each adjacent rung to one other.

10. The weighted agility ladder as recited in claim 9, wherein the slot of each socket has an enlarged portion and a narrow portion, and wherein each socket has a plate, a spring that biases the plate against the slot, and an actuation lever for manually moving the plate away from the slot.

11. The weighted agility ladder as recited in claim 10, wherein the uppermost rung has a handle midway between its ends and the lowermost rung has a handle midway between its ends.

12. The weighted agility ladder as recited in claim 11, wherein the rails are elastic for stretching and tensioning when one of the rungs is pulled away from another of the rungs.

* * * * *